US005396307A

United States Patent [19]

Pummell et al.

[11] Patent Number: 5,396,307

[45] Date of Patent: Mar. 7, 1995

[54] GUIDE APPARATUS

[75] Inventors: Leslie J. H. Pummell, Rickmanswork; Paul C. Ward, Oxhey; Stephen J. Kingdon, St Albans; James A. Oldfield, Nags Head Lane, all of United Kingdom

[73] Assignee: Eastman Kodak Company, Rochester, N.Y.

[21] Appl. No.: 36,565

[22] Filed: Mar. 24, 1993

[30] Foreign Application Priority Data

Mar. 24, 1992 [GB] United Kingdom ..... 9206390

[51] Int. Cl.[6] ..... G03D 3/08; G03D 13/02

[52] U.S. Cl. ..... 354/319; 354/337

[58] Field of Search ..... 354/317–324, 354/331, 336, 338, 339, 337; 271/264; 226/91, 92, 196, 198; 118/411, 424, 637, 642

[56] References Cited

U.S. PATENT DOCUMENTS

| | | | |
|---|---|---|---|
| 1,907,718 | 5/1933 | Bodan et al. | 354/339 |
| 2,488,142 | 11/1949 | Pratt et al. | 354/339 |
| 3,421,675 | 1/1969 | Brown et al. | 226/196 |
| 3,523,498 | 8/1970 | Phelps et al. | 354/339 |
| 3,651,782 | 3/1972 | MacDonald, Jr. | 118/411 |
| 3,691,926 | 9/1972 | Kwiatkowski | 354/319 |
| 3,769,897 | 11/1973 | Zwettler et al. | 354/322 |
| 3,776,119 | 12/1973 | Slingsby et al. | 354/320 |
| 4,523,754 | 6/1985 | Hisajima et al. | 271/264 |
| 4,674,438 | 6/1987 | Keable | 118/642 |

FOREIGN PATENT DOCUMENTS

| | | | |
|---|---|---|---|
| 844158 | 7/1939 | France | G03D 3/13 |
| 3209262 | 9/1983 | Germany | G03D 3/08 |
| 541889 | 12/1941 | United Kingdom | G03D 3/13 |
| 1418523 | 12/1975 | United Kingdom | G03D 3/08 |
| 2145244 | 3/1985 | United Kingdom | G03D 9/00 |
| 0575609 | 10/1977 | U.S.S.R. | 354/324 |

*Primary Examiner*—D. Rutledge
*Attorney, Agent, or Firm*—Frank Pincelli

[57] ABSTRACT

It is well-known to use grooves to guide photographic material through processing apparatus. However, there is a tendency for debris to accumulate in the bottom of the grooves. Furthermore, the machining operation needed to form such grooves is complicated in particular where bends and changes in direction are required. Described herein is a guiding arrangement in which pairs of parallel plates (20, 22, 24, 26) are used to define a gap (30) through which material (40) is transported. The arrangement comprises an upper plate pair (20, 22) which is arranged to be offset with respect to a lower plate pair (24, 26), the plates in each pair being parallel to one another.

7 Claims, 2 Drawing Sheets

GUIDE APPARATUS

FIELD OF THE INVENTION

This invention relates to guide apparatus and is more particularly concerned with guide apparatus for use with photographic processing apparatus.

BACKGROUND ART

Photographic film tends to be processed in a single strip once the film has been removed from its cassette. Strips of negative film are processed by transporting them, either as a single individual strip or as a continuous length comprising two or more strips of shorter lengths, through a series of processing solutions in various tanks in the processing apparatus.

In known processing apparatus;, the film strip is pulled through tanks containing the processing solutions either by a leader which is attached to the leading edge of the film strip, or by moving a rack or spiral containing the film strip from tank to tank. Individual film strips may be pre-spliced into a long reel with a leader card at the front end, clipped to a rack, or fed into a spiral.

Where the film strip is attached to a leader, it is unloaded from the cassette and attached to the leader in a manual operation. The leader is then fed into the processing apparatus so that the film can be processed as it is transported through the apparatus.

It is well known to guide film or other photographic material through the apparatus by pushing or pulling the material through grooves formed in side walls of processing racks. These grooves are machined in the side walls and therefore have a fixed position relative to the processing rack.

In the arrangement described above, the grooves may collect dirt and debris which may eventually build up to such an extent that the material being processed cannot easily be transported during processing and may become damaged. Furthermore, if the material being processed is damaged along its edges, the positive location in the grooves as the material is drawn through the processing apparatus may be lost causing the material to jam. This causes problems for an operator who then has to strip the appropriate rack and remove the material causing the jam.

EP-A-0 168 690 discloses a guiding device for use in copying apparatus. This device comprises a lower plate and an upper plate each of which have a plurality of dependent portions, the plates being arranged so that the dependent portions of each plate face each other and are aligned to define a path for movement of the copying paper. The plates lie parallel to the direction of travel of the paper through the copying apparatus, and the dependent portions allow the copying paper to be guided across its entire surface as it travels through the apparatus.

However, in photographic processing apparatus, the widths of material involved are considerably less than that utilized in copying apparatus. As a result, there is no need for the material to be guided across its entire surface. Furthermore, photographic material, film or paper, is inherently stiffer than copying paper and it is possible to guide the material solely at its edges in most instances.

It is therefore an object of the present invention to provide a guiding arrangement for photographic processing apparatus in which guide plates are used both to define a path through the apparatus for the material being processed and to guide the material as it passes through the processing apparatus.

SUMMARY OF THE INVENTION

According to one aspect of the present invention, there is provided a guiding arrangement comprising an upper plate pair formed by two parallel plates, and a lower plate pair formed by two further parallel plates, the upper and lower plate pairs being arranged so that lower edges of the upper pair and upper edges of the lower pair define a gap therebetween through which material can be transported, characterized in that the parallel plates of the upper plate pair are offset relative to the parallel plates of the lower plate pair, and in that the material is substantially perpendicular to the plates.

By this arrangement, thin guide plates can be made by milling or stamping and simply bolted together as desired to define the gap through which the material is transported.

Furthermore, it is simpler to form curved paths using these plates.

According to a second aspect of the present invention, there is provided photographic processing apparatus including a guiding arrangement as described above.

BRIEF DESCRIPTION OF THE DRAWINGS

For a better understanding of the present invention, reference will now be made, by way of example only, to the accompanying drawings in which.

DESCRIPTION OF THE PREFERRED EMBODIMENT

Figure 1:
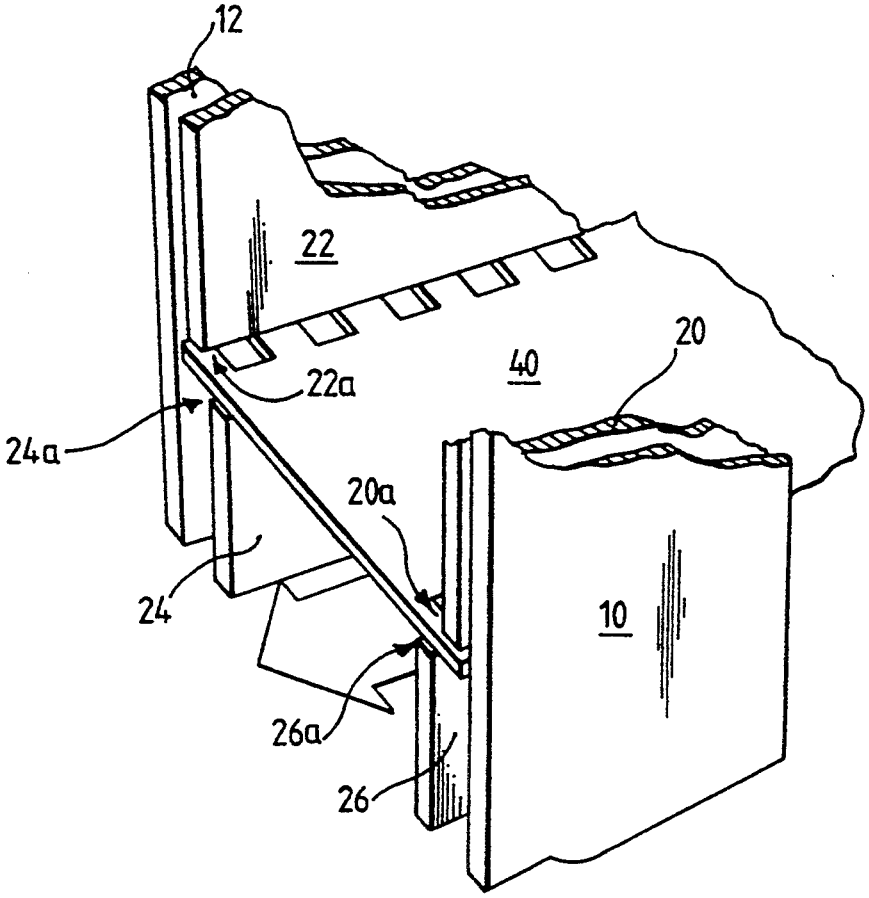
FIG. 1 is a schematic perspective view of a first embodiment of a guide plate arrangement constructed in accordance with the present invention.
Figure 2:
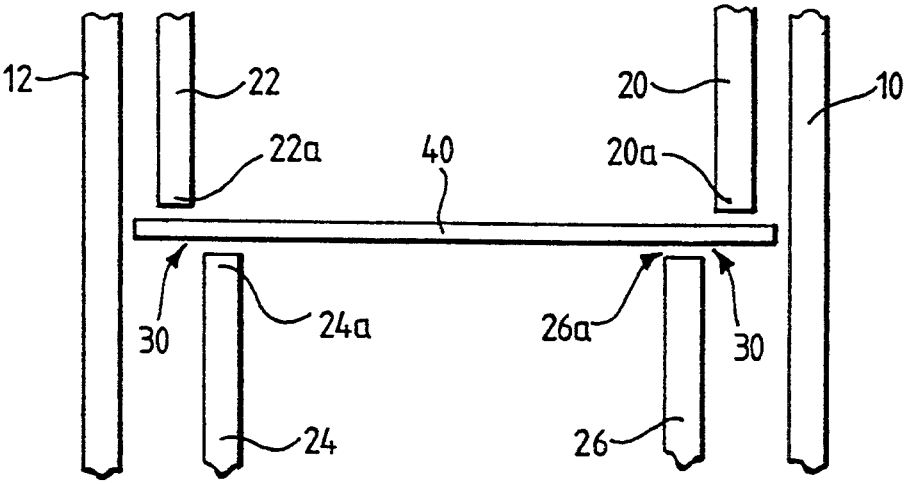
FIG. 2 is a side elevation of the arrangement shown in FIG. 1.

Referring initially to FIGS. 1 and 2, side walls 10, 12 of a processing rack are shown. An upper pair of parallel plates 20, 22 and a lower pair of parallel plates 24, 26 are arranged adjacent to, but not touching, the side walls 10, 12 of the rack. Lower edges 20*a*, 22*a* of the upper plates 20, 22 and upper edges 24*a*, 26*a* of the lower plates 24, 26 define a narrow gap 30 through which a strip of film 40 can be guided. The gap 30 is typically 2 mm wide.

As is shown more clearly in FIG. 2, the upper plates 20, 22 are spaced apart at a different distance to the lower plates 24, 26 so that they are slightly offset. This arrangement allows the film 40 to be guided, not between two aligned thin plates, but effectively between the overall width defined by the outermost faces 22*b*, 24*b* and 20*b*, 26*b* (as shown) of two such thin plates, thereby providing a greater area over which the film 40 can be guided.

Naturally, the plates may overlap providing a smaller overall width. Alternatively, the plates may be spaced apart to provide a greater overall width.

However, it is not necessary that the upper plates 20, 22 and the lower plates 24, 26 be spaced apart different distances.

Figure 3:
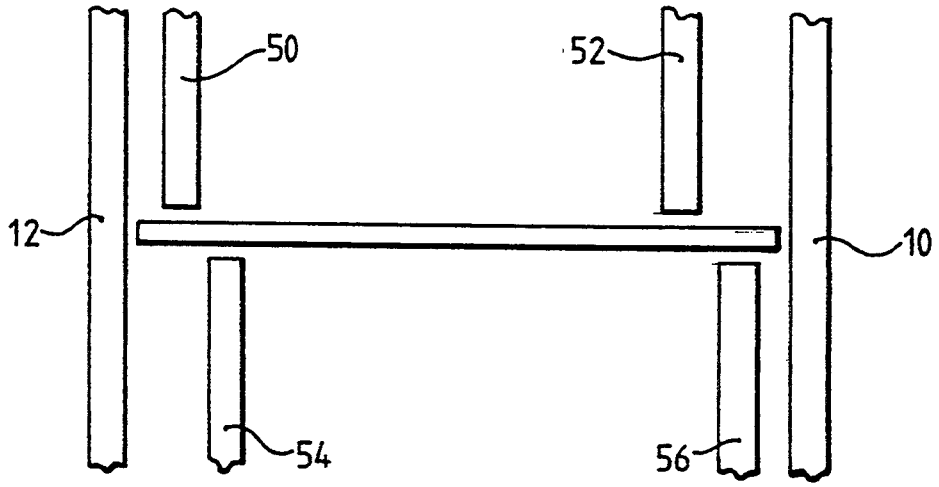
FIG. 3 is a side elevation similar to that shown in FIG. 2 but illustrating a second embodiment of the present invention.

In FIG. 3, upper plates 50, 52 and lower plates 54, 56 are shown spaced apart the same distance, but the upper parallel plate pair 50, 52 are offset in relation to the lower plate pair 54, 56. This still provides a gap defined by the combined widths of two plates.

Naturally, it would also be possible to invert the parallel plate pairs if the application made it necessary. Furthermore, the arrangement according to the present invention can be operated on its side, that is, with the plate pairs lying in a horizontal plane instead of a vertical plane as shown in the drawings.

It is envisaged that the guiding arrangements described above would be utilized in a film unloading device. The film paths through this unloading device would make use of flat plate guides as described above.

In a prototype of the unloading device, the upper and lower parallel plate pairs were made of 2 mm thick PVC sheets. Each plate of the upper plate pair was spaced away from its adjacent side wall at a distance of 4.5 mm. Similarly, each lower plate was spaced at a distance of 6.5 mm from the side walls. The upper plate pair, that is those spaced 4.5 mm from the side walls, were on the emulsion side of the film, mostly along the line of the perforations whilst the lower plate pair, that is those spaced 6.5 mm from the side walls, were guiding the back of the film.

Naturally, the dimensions described above can be altered to suit different needs.

The thin edges between which the film is guided, may be polished or surface treated in any suitable way to minimize the amount of damage to the fragile film surfaces.

The guiding arrangement according to the present invention has the following advantages:

a) There is no need to mill narrow grooves (typically 2 mm wide and 2 mm deep) in the side walls of the processing rack. This reduces manufacturing costs.

b) The offset plates provide more positive guiding of the film around corners and bends.

c) Torn film will still be guided effectively through the processing apparatus due to the combined width of the offset plates.

d) Tolerances in production of the plates can be relaxed due to their offset positioning.

e) As there is no "bottom" to the 'groove' defined by the offset plates, there is no space in which debris can lodge.

f) With 35 mm film, it is possible to space the plates so that they lie along the line of the perforations. In the unlikely event of scratching of the film by the plates, damage would be confined to the perforation area which carries no information.

The arrangement of the present invention can be adapted so that the guide plates themselves could form the side walls of the processing rack. In this way the rack could become very light and simple, although this adds the expense of increasing the complexity of manufacture of the surrounding processing tanks.

Furthermore, the guide plate pairs may be adjustable to allow material of different sizes to be accommodated within the same processing rack.

The arrangement could also be used for propelling dry film along any desired path.

Any thin sheet material which needs to be moved along a complex path, in the dry or in the wet, could be guided using this arrangement.

We claim:

1. A guiding arrangement comprising an upper plate pair formed by two parallel plates, and a lower plate pair formed by two further parallel plates, the upper and lower plate pairs being arranged so that lower edges of the upper pair and upper edges of the lower pair define a gap therebetween through which a material, having a pair of lateral edges and a side on which an emulsion layer is provided, can be transported, characterized in that the parallel plates of the upper plate pair are offset relative to the parallel plates of the lower plate pair, the upper plate pair is spaced apart a distance which is greater than that by which the lower plate pair is spaced apart, the plates being relatively thin and are of the same thickness, each plate has a thickness of about 2 mm, the pair plates facing the side on which the emulsion is provided being positioned solely along the lateral edges of the material, and in that the material is substantially perpendicular to the plates.

2. A guiding arrangement comprising an upper plate pair formed by two independent and adjustable parallel plates, and a lower plate pair formed by two independent and adjustable parallel plates, the upper and lower plate pairs being arranged so that lower edges of the upper pair and upper edges of the lower pair define a gap therebetween through which a material can be transported, characterized in that the parallel plates of the upper plate pair are offset relative to the parallel plates of the lower plate pair, and in that the material is substantially perpendicular to the plates.

3. An arrangement according to claim 2, wherein the upper plate pair is spaced apart a distance which is greater than that by which the lower plate pair is spaced apart.

4. An arrangement according to claim 2, wherein the upper and lower plate pairs are spaced apart the same distance.

5. An arrangement according to claim 2, wherein the plates are relatively thin and are of the same thickness.

6. An arrangement according to claim 5, wherein each plate has a thickness of 2 mm.

7. An arrangement according to claim 2, wherein the gap is typically 2 mm.

* * * * *